US007384058B2

(12) United States Patent
Munsey et al.

(10) Patent No.: US 7,384,058 B2
(45) Date of Patent: Jun. 10, 2008

(54) FOLDABLE WHEELCHAIR WITH EXTENSIBLE LINK ASSEMBLY AND METHOD

(75) Inventors: Douglas H. Munsey, Stevens Point, WI (US); Murray G. Slagerman, Rosser (CA)

(73) Assignee: KI Mobility LLC, Stevens Point, WI (US)

( * ) Notice: Subject to any disclaimer, the term of this patent is extended or adjusted under 35 U.S.C. 154(b) by 322 days.

(21) Appl. No.: 11/030,392

(22) Filed: Jan. 5, 2005

(65) Prior Publication Data

US 2006/0145456 A1 Jul. 6, 2006

(51) Int. Cl.
*B62B 3/02* (2006.01)

(52) U.S. Cl. ..... 280/642; 280/647; 280/649

(58) Field of Classification Search ..... 280/642, 280/647, 649, 650, 47.38, 47.4
See application file for complete search history.

(56) References Cited

U.S. PATENT DOCUMENTS

| | | | | |
|---|---|---|---|---|
| 4,042,250 | A | 8/1977 | Rodaway | |
| 4,542,918 | A | 9/1985 | Singleton | |
| 4,682,783 | A | 7/1987 | Küschall | |
| 4,861,056 | A | 8/1989 | Duffy, Jr. et al. | |
| 4,989,890 | A | 2/1991 | Lockard et al. | |
| 5,112,069 | A * | 5/1992 | Aldus et al. | 280/42 |
| 5,253,886 | A | 10/1993 | Weege | |
| 5,328,183 | A | 7/1994 | Counts | |
| 5,358,263 | A * | 10/1994 | Aldus et al. | 280/42 |
| 5,496,050 | A * | 3/1996 | Geiger et al. | 280/250.1 |
| 5,857,688 | A * | 1/1999 | Swearingen | 280/250.1 |
| 5,915,709 | A | 6/1999 | Radjenovic et al. | |
| 6,227,559 | B1 * | 5/2001 | Slagerman et al. | 280/650 |
| 6,241,275 | B1 | 6/2001 | Slagerman | |
| 6,572,133 | B1 | 6/2003 | Stevens | |
| 6,616,172 | B1 * | 9/2003 | Cockram | 280/647 |

(Continued)

OTHER PUBLICATIONS

Brochure entitled *The City Sports—New 01m*, date unknown, Star OX, Japan.

(Continued)

*Primary Examiner*—Christopher Bottorff
(74) *Attorney, Agent, or Firm*—Ryan W. Dupuis; Michael R. Williams; Adrian D. Battison

(57) ABSTRACT

A foldable wheelchair (21) and foldable wheelchair frame assembly (26, 126) including a pair of side frames (24, 124, 224, 324), a cross-bracing frame assembly (36, 136) coupling the side frames (24, 124, 224, 324) together for movement transversely between a spaced apart deployed position and a proximate folded position. A variable length link assembly (61, 161, 261, 361) is mounted into and forms a part of the cross-bracing frame assembly (36, 136) in a position between at least one of the side frames (24, 124, 224, 324) and a remainder of the cross-bracing frame assembly. The extensible link assembly (61, 161, 261, 361) being formed for variation of the overall length in a direction extending transversely between the side frames (24, 124, 224, 324) during movement of the side frames (24, 124, 224, 324) between the deployed and the folded positions so as not to force the side frames (24, 124, 224, 324) into unparallel motion which causes the upholstery to bind the folding mechanism. The extensible link assembly (61, 161, 261, 361) is preferably and over-center linkage that is resiliently biased to the extended position. A method of providing a foldable wheelchair frame assembly (26, 126) is also disclosed.

31 Claims, 15 Drawing Sheets

U.S. PATENT DOCUMENTS

| | | | | |
|---|---|---|---|---|
| 6,769,503 | B2 * | 8/2004 | Cheng | 180/68.5 |
| 6,932,369 | B2 * | 8/2005 | Walsh et al. | 280/250.1 |
| 7,000,938 | B2 * | 2/2006 | Watkins | 280/642 |
| 7,052,023 | B2 * | 5/2006 | Chen et al. | 280/47.38 |
| 2001/0013721 | A1 | 8/2001 | Ishii | |
| 2003/0006578 | A1 * | 1/2003 | Melgarejo et al. | 280/250.1 |
| 2003/0189317 | A1 * | 10/2003 | Chen et al. | 280/650 |
| 2004/0021298 | A1 * | 2/2004 | Tsai | 280/642 |
| 2004/0021299 | A1 * | 2/2004 | Tsai | 280/642 |

OTHER PUBLICATIONS

Brochure entitled *OX—MC-01*, date unknown, OX, Japan.

* cited by examiner

FOLDABLE WHEELCHAIR WITH EXTENSIBLE LINK ASSEMBLY AND METHOD

TECHNICAL FIELD

The present invention relates, in general, to foldable wheelchairs, and more particularly, relates to wheelchairs which have X-shaped cross-bracing frame assemblies that fold or scissor to allow the side frames of the wheelchairs to be moved between a spaced apart deployed position for use and a folded position for storage or transport.

BACKGROUND ART

Wheelchairs have become more portable and lightweight over the years to meet the needs of the active lives of their users. Portability has been improved by providing for so-called "folding" frame wheelchairs, which increase wheelchair portability over rigid or non-folding frame wheelchairs. One of the most popular approaches to providing a foldable or collapsible wheelchair is to couple the side frames of the chair together by a cross-bracing assembly in which the cross-bracing members, which are almost always tubes, are pivotally coupled together proximate their mid-points in an "X" shape. The X-tubes of the cross-bracing assembly are also pivoted at their ends to the top and bottom members of the side frame assemblies so that the X-tubes can pivot like a pair of scissors and bring the wheelchair side frames together in a compact configuration. U.S. Pat. Nos. 4,989,890, 4,861,056, 5,915,709, 5,328,183 and 5,253,886 are all typical examples of X-tube cross-bracing assemblies which are employed to allow movement of the side frames of the wheelchair to a folded or collapsed position. There are many other examples in the patent literature of X-tube folding wheelchair frames.

Several problems have bee encountered in connection with X-tube folding wheelchair designs. More particularly, the pivotal coupling of the cross-bracing tubes or members causes arcuate movement of the side frames, which in turn, forces tilting or splaying of the side frames during movement. If too much tilting (usually an outward splaying of the top of the side frames) occurs, the backrest upholstery mounted between the side frames is strained as the side frames are forced outwardly, and the upholstery can bind and stop folding of the X-tube frame assembly, preventing it from reaching the fully deployed or open position. This problem is often overcome by providing backrest upholstery which is relatively loose so as not to bind the X-tube frame assembly as it pivots in a scissors-like action. Loose backrest upholstery, however, has the substantial disadvantage of being very poor for user posture and positioning, and therefore, employing loose backrest upholstery is not a good "solution" to accommodating the arcuate movement of the side frames induced by X-tube cross bracketing assembly during folding and unfolding.

An additional problem in conventional X-tube folding wheelchairs is that seat rails or tubes are provided on the upper ends of the X-tubes of the cross-bracing assembly. These seat rails typically carry sling seat upholstery that has a transverse length dimension across the chair such that the sling seat goes into tension as the chair folds open to the fully deployed position. The tension of the seat upholstery maintains a pre-load on the folding X-tube cross-bracing assembly, which increases the stability and rigidity of the folding chair when it is in the deployed condition. While this technique for rigidifying the folding wheelchair frame is initially relatively effective, sling seat upholstery typically will stretch over time, and the pre-loading effect will be reduced or even eliminated.

Most typically, the seat rails carried by the upper ends of the X-tubes of the cross-bracing folding assembly fold down to a position superimposed over the upper frame member or tube of the side frames, as for example, can be seen in the assemblies of U.S. Pat. Nos. 4,989,890 and 4,861,056. This over and under design, however, results in a higher positioning of the seat upholstery and some additional weight in the overall wheelchair frame due to lengthier cross-bracing X-tubes which are required. Moreover, positioning the seat rails carried by the X-tubes over the uppermost side frame tubes interferes with the ability to have the backrest upholstery supporting frame members fold or pivot downwardly over the seat side frames to further reduce the bulk of the wheelchair.

Folding wheelchairs have been developed, however, that employ X-tube cross-bracing frame assemblies and seat upholstery supporting rails that fold to a side-by-side position in relation to the top side frame member instead of the over and under configuration set forth above. Such prior art side-by-side folding wheelchair frame assemblies are commercially available under the trademark STAR OX, through a Japanese manufacturer, and the trademark TI SPORTS, through a United States manufacturer. These designs enable X-tube folding wheelchairs to be lower and somewhat lighter, but again the folding linkage forces arcuate motion of the side frames.

Various attempts have been made to overcome the disadvantages which are encountered in connection with X-tube folding wheelchair assemblies so as to eliminate binding, reduce the forces required to open and close the chair and make the opening and closing more smooth and uniform in its operation.

One approach to solving these problems has been to provide vertically extensible frame members in the side frames of the wheelchair in order to try to accommodate folding without binding. Typical of this approach are the frame assemblies shown in U.S. Pat. Nos. 4,042,250, 4,542,918 and 5,253,886. In U.S. Pat. No. 4,042,250 to Rodaway, for example, a series of vertically telescoping side frame members have been employed. This approach, however, is relatively complex and requires numerous parts which must be telescoped and slid vertically together over substantial distances. U.S. Pat. No. 4,542,918 to Singleton is similar in its approach to the patent to Rodaway in that there are vertically telescoped side frame tubes that attempt to accommodate the scissors action of the X-tube cross-bracing frame members. This approach is also taken in U.S. Pat. No. 5,253,886 to Weege.

Another approach was taken in the frame assembly of U.S. Pat. No. 4,682,783 to Kuschall. The cross-bracing assembly that couples the side frames together has been extensively modified, and a second pivoting cross-bracing frame added. In U.S. Pat. No. 6,572,133 to Stevens, a complex cross-bracing assembly is provided in which the components scissor in a fore-and-aft direction to accommodate frame folding, rather than having the X-tubes oriented for scissoring in a vertical direction. The complexity of this solution and its attendant weight are substantial.

In my U.S. Pat. No. 6,241,275, hinged cross-bracing links are employed to enable folding, and in U.S. Pat. No. 5,328,183 to Counts, the X-tubes are pivotally coupled at their upper ends to fixed length links that also receive pins so as to limit X-tube pivoting and support the seat assembly in the open or deployed position.

Accordingly, it is an object of the present invention to provide a foldable wheelchair, a wheelchair frame assembly and a method which do not force the side frames to fold in an unparallel manner, and accordingly, which have smoother folding characteristics that eliminate binding of the X-tube cross-bracing frame members by the upholstery during folding.

Another object of the present invention is to provide an improved wheelchair folding mechanism and method which improves the overall rigidity of the wheelchair frame and eliminates the dependence on tensioning of the upholstery to achieve frame rigidity.

Another object of the present invention is to provide a foldable wheelchair, wheelchair frame assembly and method which eliminate the need to employ slack backrest upholstery in order to accommodate folding and unfolding.

Still a further object of the present invention is to provide a foldable wheelchair, foldable wheelchair frame assembly and method which reduce the weight and size of the wheelchair frame, which are economical to manufacture and which accommodate frame size modifications, all while having an overall aesthetic appearance.

The foldable wheelchair, wheelchair frame assembly, and the method of the present invention, have other objects and features of advantage which will become apparent from, or are set forth in more detail in, the accompanying drawing and the following Best Mode of Carrying Our the Invention.

DISCLOSURE OF THE INVENTION

The foldable wheelchair frame assembly of the present invention comprises, briefly, a pair of side frames; a cross-bracing frame assembly coupling the side frames together for movement of the side frames transversely between a spaced apart deployed position and a proximate folded position; and a link assembly mounted in the cross-bracing assembly between at least one of the side frames and a remainder of the cross-bracing frame assembly with the link assembly being formed for variation of the overall length of the link assembly in a direction extending transversely between the side frames to prevent forcing of the side frames into unparallel movement during movement of the side frames between the deployed position and the folded position. The link assembly preferably is pivotally coupled at one end to the side frame and pivotally coupled at the other end to the remainder of the cross-bracing frame assembly, and the link assembly advantageously is extensible and retractable, including a slidable link member reciprocally mounted in a sleeve for relative extension and retraction of one of the sleeve and the slidable link during movement of the side frames between the deployed and folded positions. The extensible link assembly also preferably is bi-stable, for example, by moving along an arcuate path over a center line with one of the sleeve and the slidable link member being biased by spring biasing means to an extended condition on either side of the center line to provide the bi-stable over-center linkage.

A method of providing a foldable wheelchair frame is also provided which comprises, briefly, the steps of coupling a pair of side frames together by a cross-bracing frame assembly formed for lateral movement of the side frames between a deployed position and a folded position; and mounting at least one link assembly in the cross-bracing frame assembly between at least one of the side frames and a remainder of the cross-bracing frame assembly for lateral movement of the link assembly to enable the side frames to move between the deployed and the folded positions without being forced to an unparallel movement causing the upholstery to bind the frame assembly.

BEST MODE OF CARRYING OUT THE INVENTION

Reference will now be made in detail to the preferred embodiments of the present invention, examples of which are illustrated in the accompanying drawings. While the invention will be described in connection with the preferred embodiments, it will be understood that they are not intended to limit the invention to those embodiments. On the contrary, the invention is intended to cover alternatives, modifications and equivalents, which may be included within the spirit and scope of the invention, as defined by the appended claims.

Figure 8:
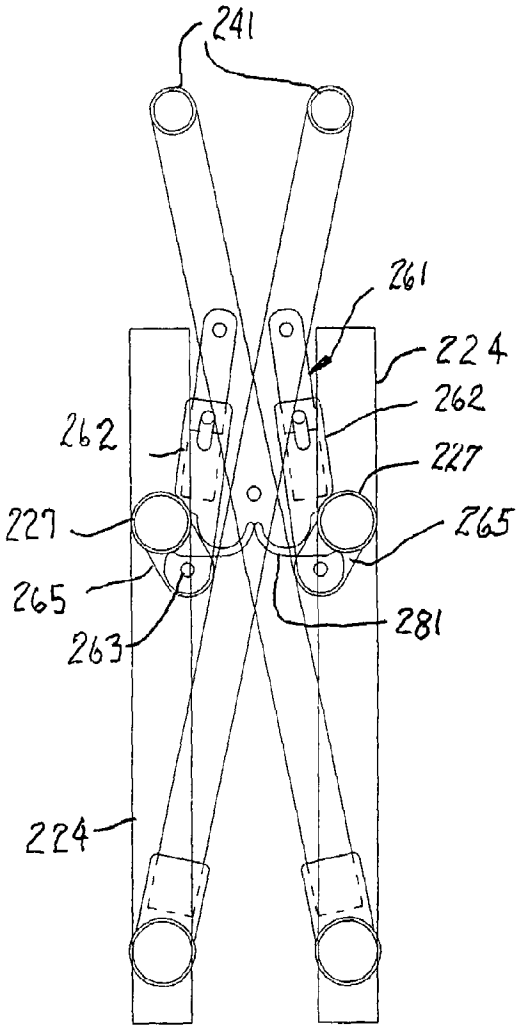
FIG. 8 is a front elevation view of the frame assembly of FIG. 7 shown in a folded condition.
Figure 9:
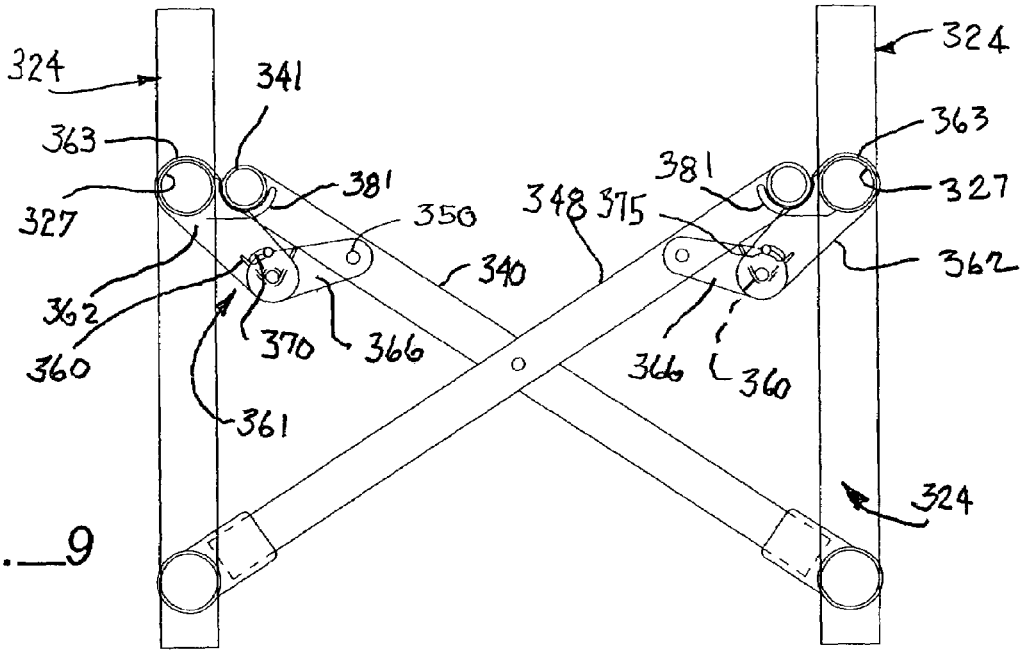
FIG. 9 is a front elevation view of a further alternative embodiment of a foldable frame assembly of the present invention in which pivoting link assemblies connect the cross-bracing members to the side frame assemblies.

In FIGS. 1-6, an embodiment of the present foldable wheelchair, generally designated 21, is shown in which the X-tube cross-bracing assembly includes two pairs of X-tubes between which an extensible link assembly of the present invention is mounted. In FIGS. 8 and 9, the extensible link assemblies have been mounted to short downwardly depending arms, rather than directly to the side frames, and in FIGS. 9 and 10 the link assembly is comprised of members which are pivoted together rather than being extensibly telescoped. In the alternative embodiment of the present invention as shown in FIGS. 11-15, the cross-bracing frame assembly of the wheelchair has a single pair of X-tubes, with the extensible link assembly being mounted in the upper ends of each of the X-tubes.

Considering first the embodiment of FIGS. 1-6, it will be seen that foldable wheelchair 21 preferably includes a pair of relatively large drive wheels 22 and smaller caster wheels 23, both of which are mounted to wheelchair side frames, generally designated 24, which form a part of the overall wheelchair frame assembly, generally designated 26. Mounted to wheelchair frame assembly 26 also will be upholstery, namely, a backrest sheet 37 and a sling seat 39. Also typically carried by the wheelchair frame assembly will be footrest assemblies (not shown). These components are well known in the industry and will not be described in detail herein.

Various side frame configurations also are generally well known in their construction, and as here illustrated, side frames 24 include top side frame members 27, 27*a*, bottom side members 28, 28*a*, and front and rear vertically extending members or posts 29 and 31, 31*a*. Intermediate bracing posts 32 also may be provided to which the drive wheels 22 can be mounted by a wheel mounting plate 33, shown in FIG. 1. Typically, all of the side frame members and posts are tubular and formed from a lightweight material, such as aluminum, so that the overall weight of wheelchair 21 will be low while the strength is relatively high.

In order to allow wheelchair 21 to be folded or collapsed into a more compact configuration for storage and/or transport, side frames 24 are coupled together for movement transversely relative to each other by a cross-bracing frame assembly, generally designated 36. Cross-bracing frame assembly 36 is formed for transverse movement of side frames 24 between a deployed position, shown in FIGS. 1-3 and a folded position, shown in FIGS. 5A and 5B. In the deployed position, side frames 24 are spaced apart from each other for distention of the seat upholstery to permit use of the wheelchair by the user. As can be seen from FIGS. 1 and 2, when the side frames are spaced apart backrest upholstery 37 is distended between tubular handle extensions 31*a* which are mounted to the rear frame posts 31 of frame assembly 26. Typically, upholstery 37 will be a flexible fabric or sheet material that can be secured, for example, by rivets or looped ends to handle extensions 31*a*. Providing a flexible fabric sheet 37 as the backrest upholstery enables the sheet 37 to collapse as side frames 24 move between the folded and deployed positions.

In the embodiment of FIGS. 1-6, a flexible fabric sling seat 39 is mounted to fore and aft extending seat rails 41, which are carried by the upper ends of cross-bracing assembly 36. As shown, fasteners 42 mount a securement strip 43 to the upper side of tubes 41 so as to hold seat upholstery sheet 39 to the seat rails 41. Other seat upholstery mounting schemes can be employed and are well known in the industry. Again, the flexibility of sling seat 39 allows the same to be folded as the wheelchair is folded without removal of the seat upholstery. It is within the scope of the present invention, however, to have upholstery 37 and 39 be relatively inflexible and removable from their respective wheel chair frame members.

As above noted, the cross-bracing frame assembly of FIGS. 1-6 includes two pair of X-tubes which are spaced in the fore and aft direction along the wheelchair frame. Thus, cross-bracing member 44 is pivoted at 46 to cross-bracing member 47 and cross-bracing member 48 is pivoted at 49 to cross-bracing member 51 (see FIGS. 3-4A and 5A). The lower ends of cross-bracing members 44 and 48 are coupled to a common sleeve member 52, which is mounted for rotation or pivoting relative to the lower fore and aft extending side frame member 28*a*. Thus, sleeve 52 is rotatably mounted over a smaller diameter tube 28*a* (FIG. 3), which is pinned or otherwise fastened at 54 between lower side frame members 28. Such a pivotal sleeve coupling also is well known in the art. A similar sleeve 56 is provided on the other side frame members, and the lower ends of cross-bracing tubes 47 and 51 are coupled to sleeve 56, for example by welding.

The upper ends of cross-bracing tubular members 44, 47, 48 and 51 can have tubular extension members 44*a*, 47*a*, 48*a* and 51*a* telescoped therein and secured to the respective cross-bracing tubes. The tubular extensions facilitate assembly of the double X-tubes. The upper ends of cross-bracing extension member 44*a*, 47*a*, 48*a* and 51*a* carry seat rails 41, and most typically are secured thereto by welding, brazing or the like.

Figure 4A:
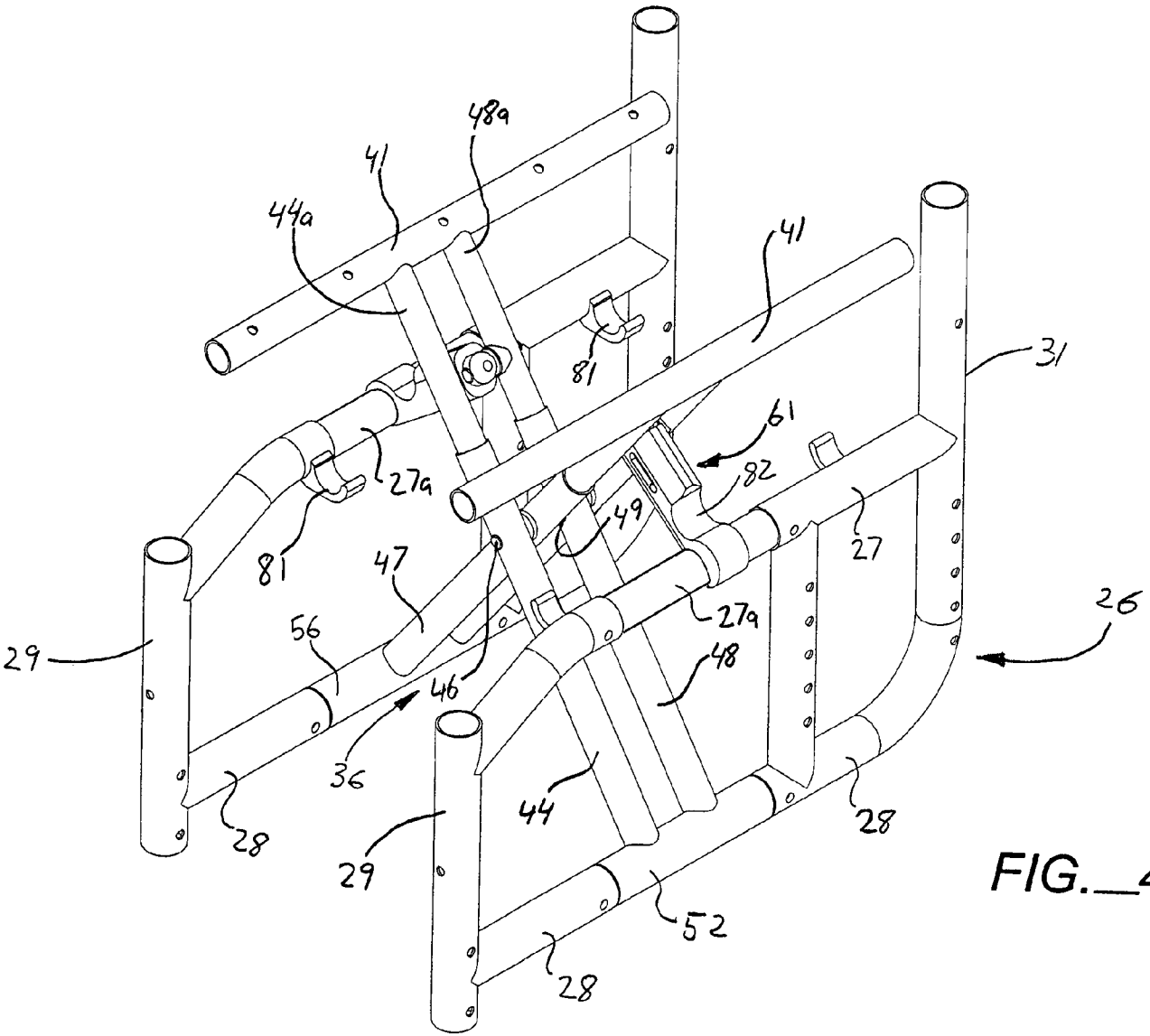
FIG. 4A is a top pictorial view of the wheelchair frame assembly of FIGS. 1 and 3, shown in a partially folded position.
Figure 4B:
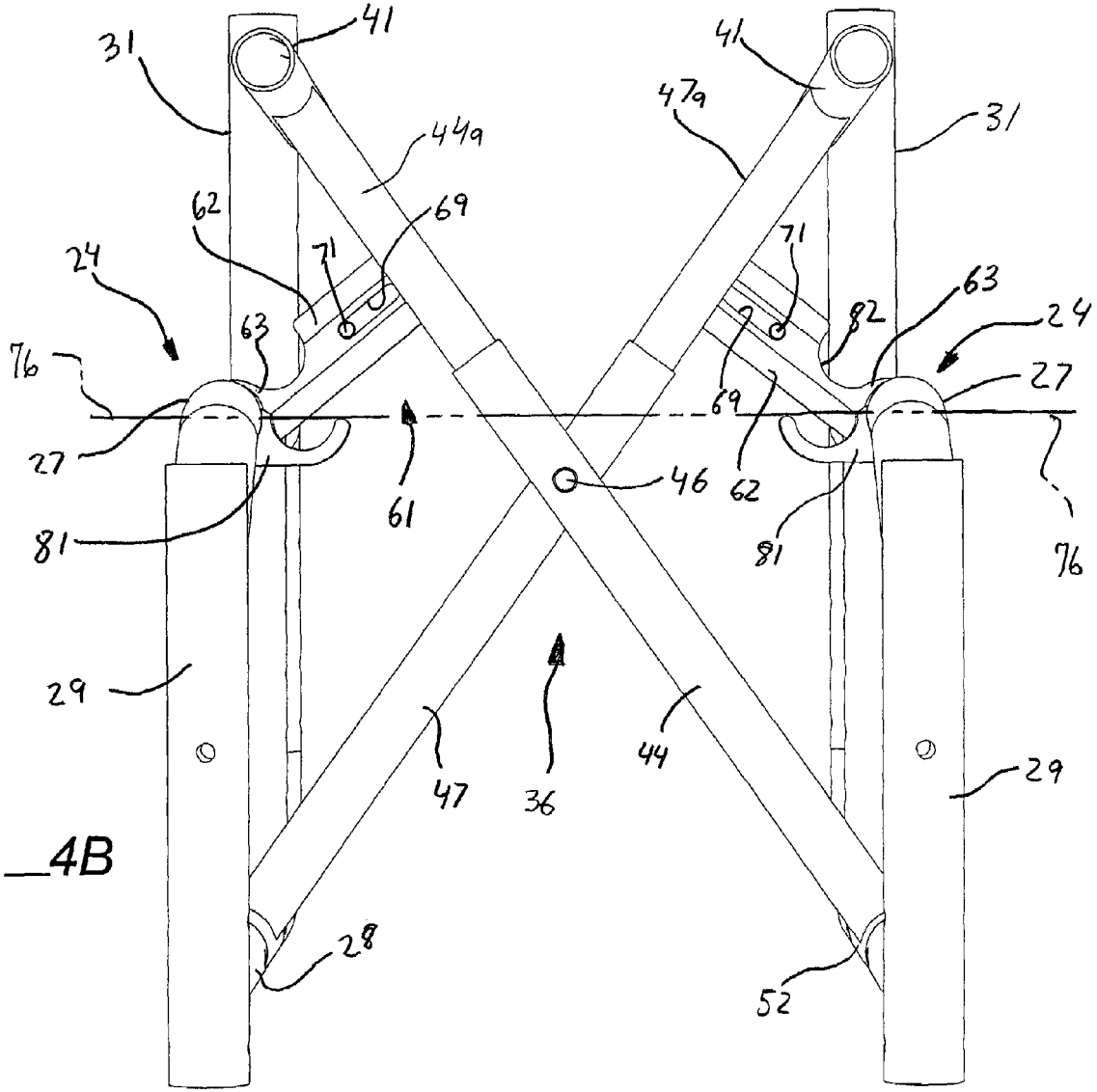
FIG. 4B is a front elevation view of the frame assembly corresponding to FIG. 4A.

As best will be seen from FIG. 4B, pivot pins 46 (and the pivot pin 49) between the pairs of cross-bracing members are located substantially at the midpoint of the length of the cross-bracing members so that, as the cross-bracing members scissor or pivot about pivot pins 46 and 49, the tops and bottoms of side frame 24 move together at substantially the same rate.

As thus far described, folding wheelchair assembly of the present invention includes components are broadly known in the prior art. As perhaps best may be seen in FIG. 4B, however, the wheelchair and wheelchair frame assembly of the present invention further include a link assembly, generally designated 61, mounted in or as a part of cross-bracing frame assembly 36. Link assembly 61 is, therefore, provided between at least one of side frames 24 and a remainder of the cross-bracing frame assembly 36. As shown in FIGS. 1-6, two link assemblies are mounted to upper frame members 27*a* on each of side frames 24. Link assemblies 61 are formed in a manner which does not force unparallel movement of the side frames during folding and unfolding. Link assemblies 61 are provided as a part of the cross-bracing assembly and are coupled at the opposite ends to a remainder of the cross-bracing assembly, namely, to upper extensions, 44*a*, 47*a*, 48*a* and 51*a*. The use of a fixed length or solid link between the upper ends of cross-bracing members and the upper side frames is broadly known, as shown in U.S. Pat. No. 5,328,183 to Counts, but the fixed length link does not solve the problem of binding up of the cross-bracing frame assembly by the backrest upholstery during folding. In Counts, the fixed length links force unparallel movement of the side frames, which is the cause of upholstery binding of the folding mechanism.

In the present invention, link assemblies 61 are extensible. As best may be seen in FIG. 6, link assembly 61 may include a sleeve member 62 pivotally coupled at an annular end 63 to the upper side frame member 27*a*. Extending outwardly from a bore 64 in sleeve 62 is a slidable link member 66 which is pivotally coupled by a pin 67 to a cross-bracing member extension, for example, extension tube 44*a*. Slidable link 66 can reciprocate in bore 64, as shown by arrows 68. Sleeve 62 can be slotted at 69 so that a transverse pin 71 carried by slider link 66 will limit the reciprocation of link 66 to the length of slot 69. Also mounted in bore 64 is a spring biasing member 72, which is preferably a compression spring.

Figure 10:
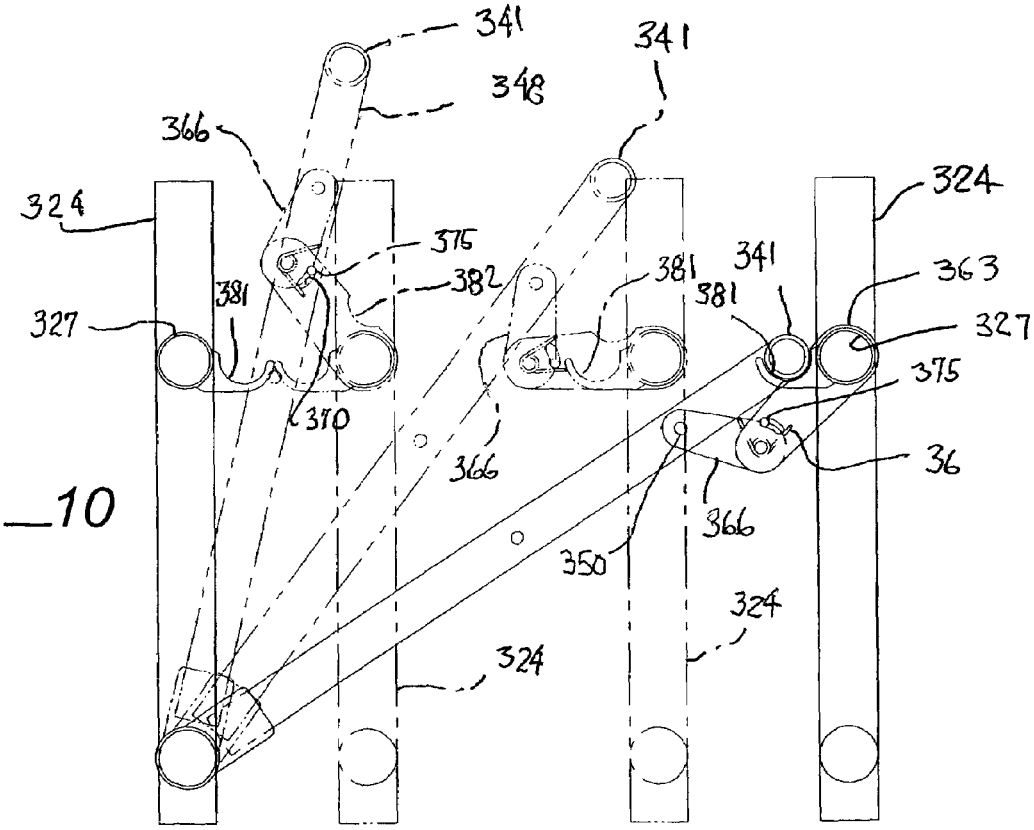
FIG. 10 is a front elevation view of the frame assembly of FIG. 9 with moved positions shown in phantom as the frame assembly moves to a folded condition.

Accordingly, extensible link assembly 61 will be seen to be spring biased so that slider member 66 is urged to the extended or outermost position relative to link assembly sleeve 62 by spring 72. Other forms of extensible link assemblies 61 are suitable for use in the wheelchair and wheelchair frame of the present invention. Thus, slider member 66 can be telescoped over sleeve 72, or the slidable link can be replaced by an extensible link, such as a spring. Moreover, in the broadest concept the link assembly does not have to be extensible in the sense of telescoped members but may have a length which is capable of changing during folding, for example, as illustrated in FIGS. 9 and 10 in which two link members are pivotally coupled together and biased by a torsional spring.

Figure 1:
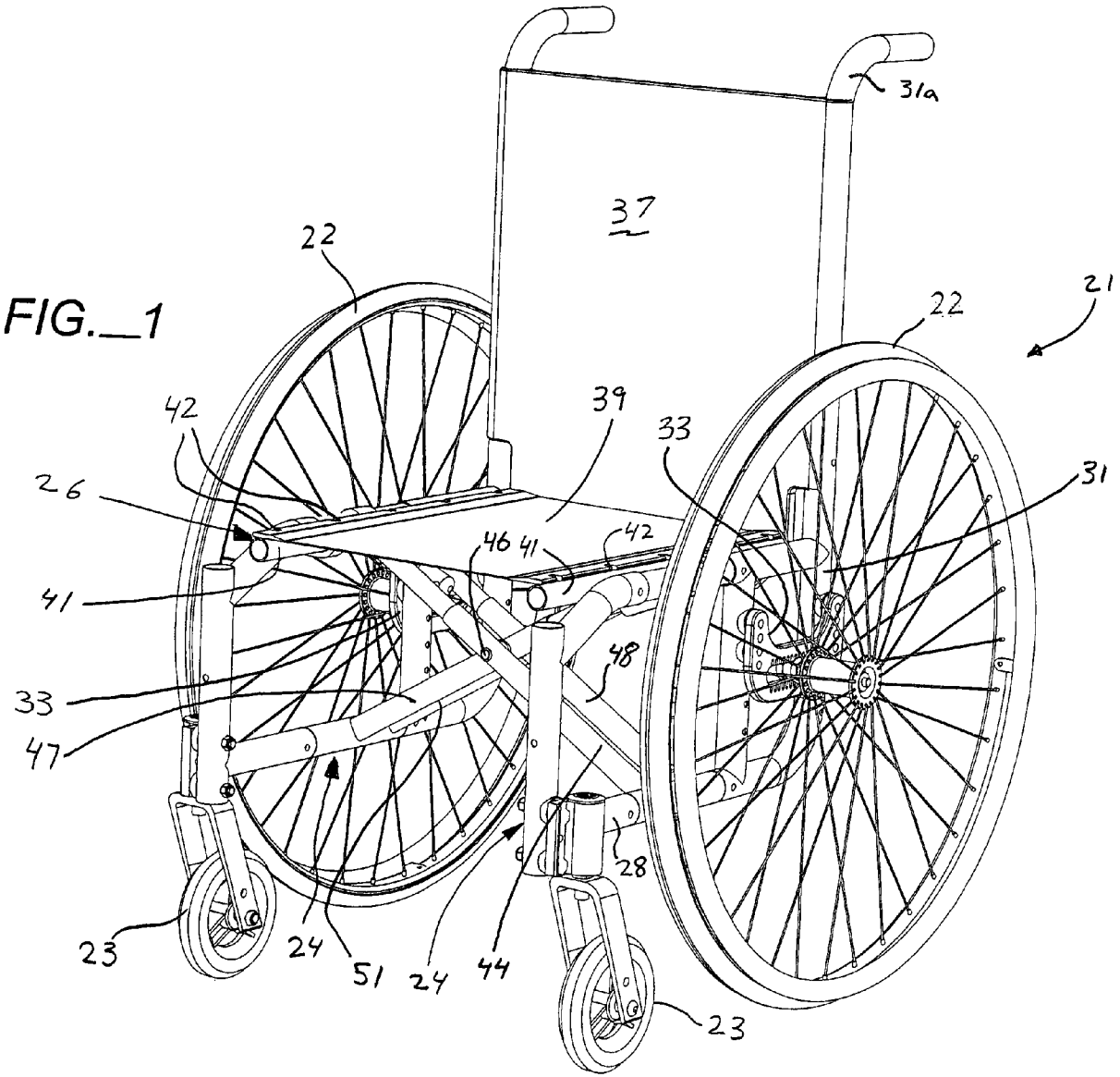
FIG. 1 is a top pictorial view of a foldable wheelchair constructed in accordance with the present invention.
Figure 2:
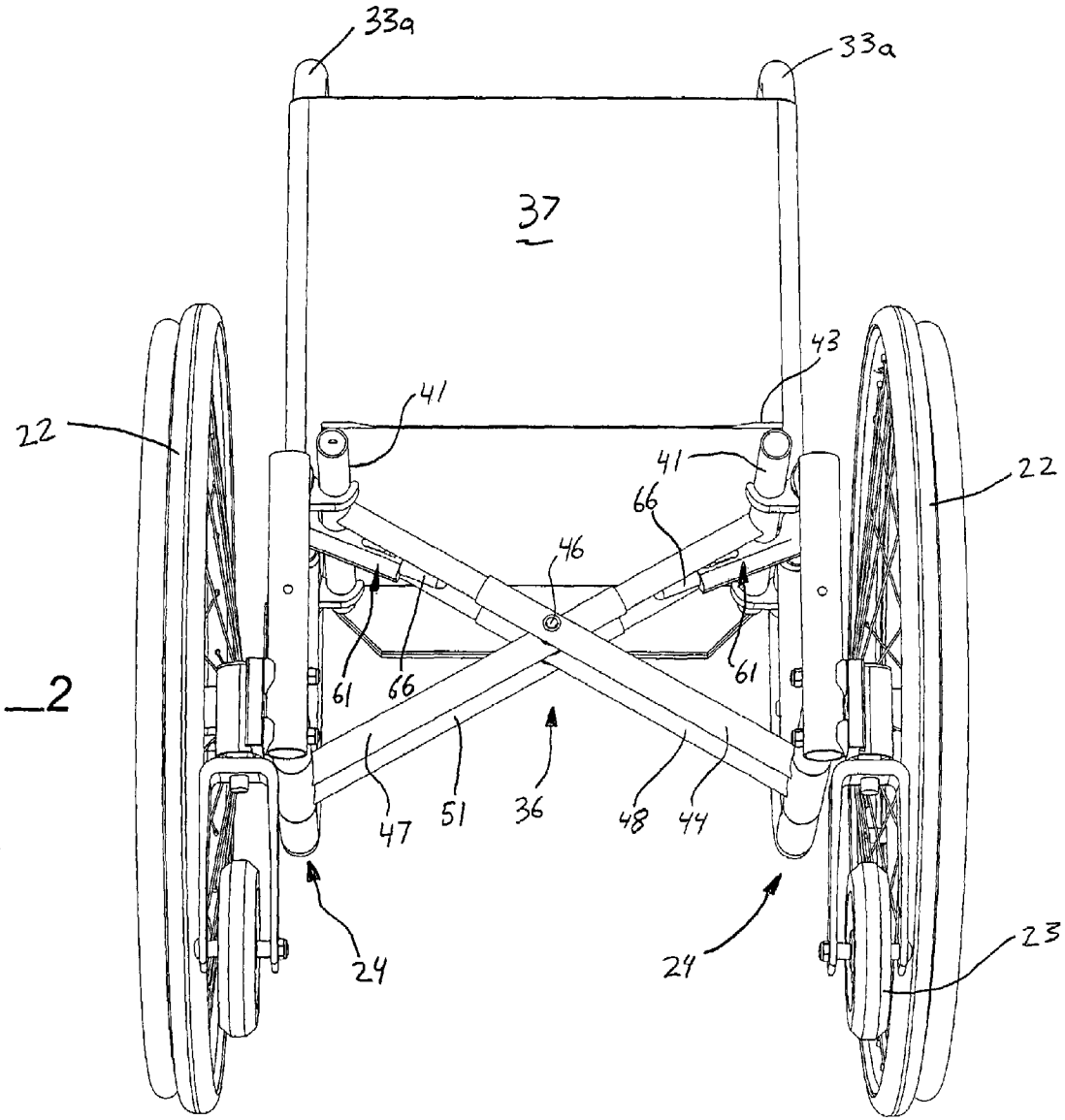
FIG. 2 is a frontal and upward view of the wheelchair of FIG. 1.
Figure 3:
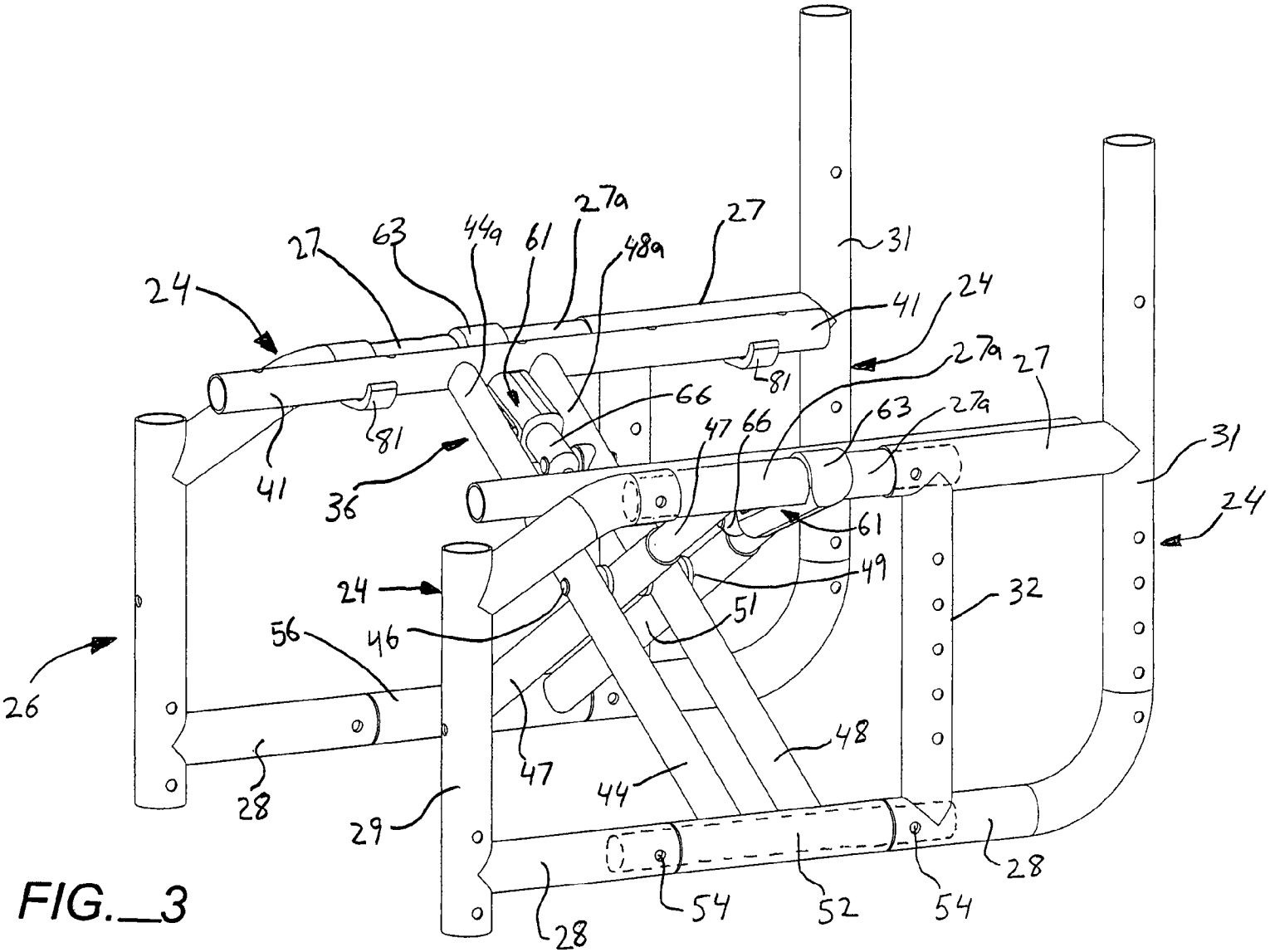
FIG. 3 is a side pictorial view of the wheelchair frame assembly of the wheelchair of FIG. 1 in a fully deployed position.

Having described the construction of extensible sleeve 61, its operation in cross-bracing frame assembly 36 can be described. In FIGS. 2 and 3, extensible link assemblies 61 will be seen to be in a downwardly oriented position, that is, they are at an angle below a horizontal plane 76 with slidable links 66 positioned below pivotal end 63 which is rotatably mounted on frame member 27*a*. Spring biasing member 72 has urged slidable link member 66 to an outward relatively extended position from assembly sleeve 62.

Figure 5A:
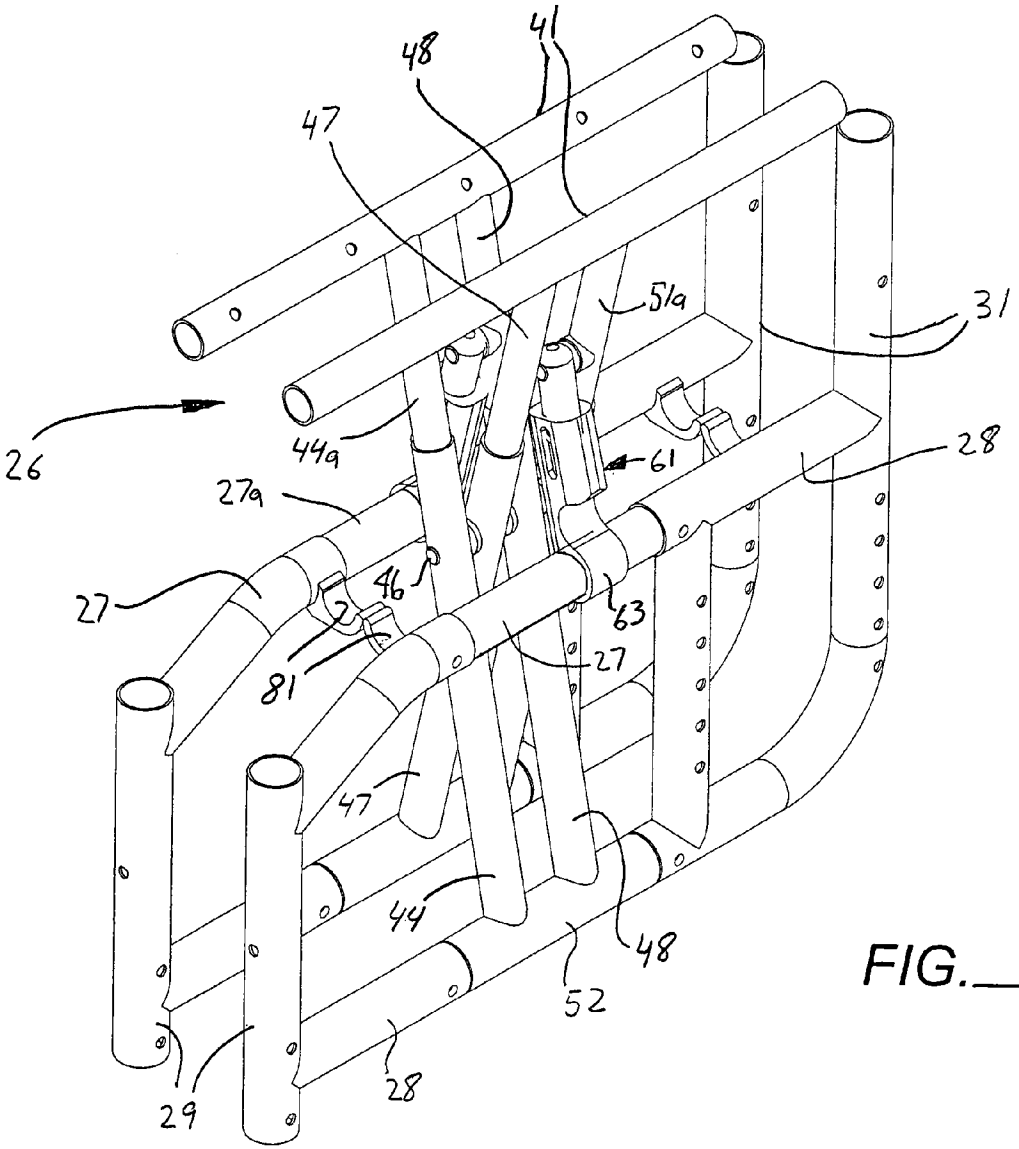
FIG. 5A is a top pictorial view of the frame assembly of FIGS. 1 and 3, shown in a fully folded position.
Figure 5B:
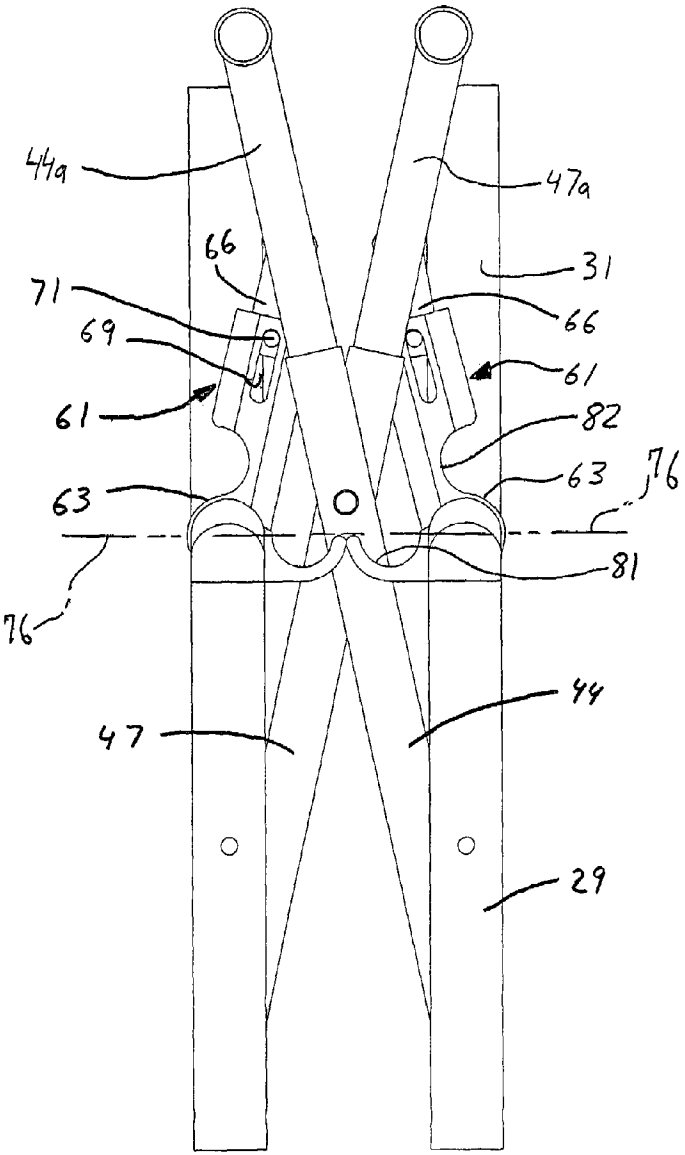
FIG. 5B is a front elevational view of the frame assembly corresponding to FIG. 5A.

As the frame assembly is folded, each link 61 pivots at ring end 63 on upper frame members 27*a* and swings over center line or plane 76, which is a horizontal plane between the centers of upper side frame members 27*a*. As this pivoting occurs about ring end 63, slidable link 66 is driven backwardly into sleeve 62 against spring 72, with pin 71 shown in FIG. 4B to be proximate the innermost end of slots 69. It should be noted that slots 69 will be dimensioned to be long enough so that pin 71 does not bottom out or hit the ends of slots 69 before the extensible link can pass through center line 76. As links 61 pivot to the folded position of FIGS. 5A and 5B, spring 72 again drives the slidable link 66 from its minimum or shortest length at center line 76 to the outermost position. As seen in FIG. 5B, therefore, transverse pin 71 is again proximate the outer end of slot 69 and preferably (although not necessarily) does not quite engage the end of slot 69 just as the frame assembly comes to the fully folded position of FIGS. 5A and 5B.

Link assembly 61 is pivotally mounted at both ends, with the slidable link member 66 enabling arcuate movement of the cross-bracing members while still not forcing side frames 24 into unparallel movement. The changeable length link assemblies of the present invention will still allow unparallel motion of the side frames, but they do not force such unparallel motion. During side frame motion, which may be unparallel, when the tension which results in the upholstery overcomes the spring biasing force in the linkage, the variable length linkage accommodates the side frame motion. This, in turn, allows backrest upholstery 37 not to bind the folding/unfolding motion and yet to be relatively taut when it reaches the deployed position, as can be sling seat 39. The extensible nature of links 61 allows the side frames to move together without binding by the backrest upholstery.

Moreover, providing an extensible link 61, which is a bi-stable over-center linkage, ensures stability in both the deployed and folded positions. Thus, in the deployed position, the spring urges slider 66 downwardly which tends to pull the seat rails 41 down against the support surfaces provided (which will be discussed below), and in the folded position, the spring biasing force tends to urge the cross-bracing member upwardly so as to hold the side frames in the folded position. Spring 72 controls the additional degree of freedom which is provided in the extensible linkage by having a slidable member 66. Thus, spring 72 prevents uncontrolled flopping of the linkage assembly and produces smooth movement of the X-tube assembly between the folded and the deployed positions as the linkage moves over-center during its arcuate movement.

The result is that the wheelchair upholstery can be more taut for better posture and positioning of the user. The force required to start folding or unfolding is reduced. Very importantly, the backrest upholstery will not bind up the cross-bracing system during its movement so that the movement is very smooth and uniform.

In the embodiment shown in FIGS. 1-6, seat rails 41 are in side-by-side relation to the top frame tubes 27, 27*a* when the wheelchair frame is in the deployed position for use. This allows the seat upholstery 39 to be somewhat lower than the more widely used construction in which the rails 41 are superimposed in an over and under configuration. The link assemblies of the present invention, however, are suitable for use with wheelchairs that are constructed such that top rails 41 fold out to a deployed position over the side frame members 27, 27*a*.

In this side-by-side construction, it is further preferable to provide side frames 24 with receivers 81 which are mounted to and extend inwardly from the side frames. Receivers 81 are shaped to matingly receive and support fore and aft extending seat rails 41 when the frame is moved to the deployed position. Additionally, sleeve 62 of the extensible link assembly 61 is provided with an upwardly facing recess 82 dimensioned to receive seat rails 41 so that a combination of the receivers 81 and recess 82 will support the seat rails along their length for greater stability and frame rigidity. Moreover, these receivers eliminate the need to depend upon sling seat upholstery tension for frame rigidity, and the side-by-side positioning of seat rails 41 and frame members 27, 27*a* reduces the overall height of the chair and the amount of material required for the cross-bracing members. This, in turn, reduces chair weight somewhat.

Additionally, by incorporating extensible link assembly 61 into the cross-bracing frame assembly, the extent of the telescopic movement of parts is greatly reduced. Thus, while the prior art approach of vertical telescoping the side frames requires a relatively long stroke between telescoped parts, the laterally or transversely moving link assembly of the present invention employs a relatively short stroke, which decreases the likelihood of binding and wear.

While the preferred embodiments of the present invention have a link assembly 61 coupled to both side frames, it would be possible to provide such a linkage on only one side of the cross-bracing assembly, with the other side being a non-extensible linkage. This most preferably would be accomplished by using an extensible linkage which has a somewhat longer stroke for the slidable link member. This approach is undesirable for wheelchairs having smaller widths.

Figure 7:
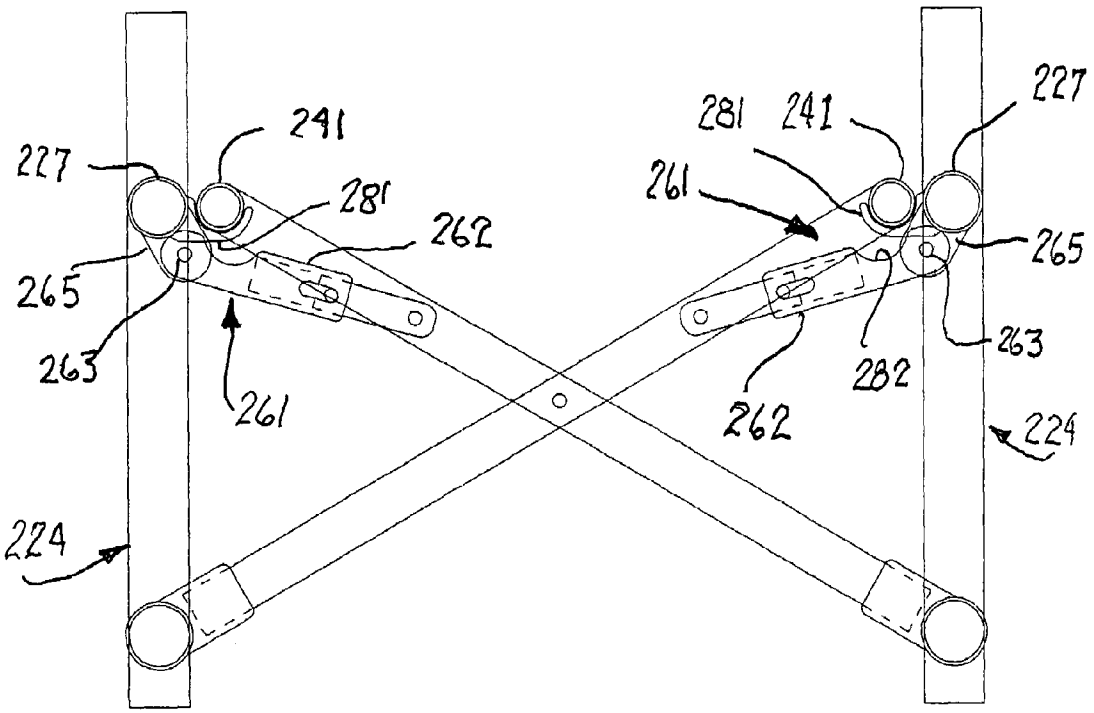
FIG. 7 is a front elevation view of an alternative embodiment of a foldable frame assembly of the present invention in which extensible link assemblies are mounted by arms to the side frame assemblies.

Referring now to FIGS. 7 and 8, an alternative embodiment of a folding wheelchair frame is shown in which extensible link assemblies 261 are provided that are mounted to short arms 265 carried by side frame assemblies 224. Link assemblies 261 may be constructed in the same manner as described above in connection with link assemblies 61. Instead of having sleeves 262 pivotally mounted directly to upper side frame 227, however, arms 265 are coupled, preferably rigidly coupled, to upper side frame members 227, and sleeve 262 is pivotally pinned at 263 to the downwardly depending arms 265. Since sleeves 262 are now pivotally coupled below side frame members 227, the sleeves include a recess 282 which mates with the side frame members 227 in the folded condition of FIG. 8. Receivers 281 support members 241 in the deployed position.

The length of arms 265, and their angle with respect to side frame members 227, can be varied considerably within the scope of the present invention, with attendant geometry changes in link assembly 261, as will be apparent to one skilled in the art.

A further alternative embodiment is shown in FIGS. 9 and 10. Instead of telescopically extensible link assemblies 61 of FIGS. 1-6, the link assembly 361 of FIGS. 9 and 10 is extendable and retractable by reason of having two link members 362 and 366 pivotally coupled together. Thus, link assembly 361 changes its length by pivotal movement of link members so that the ability to change length does not force the side frames 324 to move in an unparallel manner during folding and unfolding. The parallel movement of side frames 324 is best seen in FIG. 10, but the key is that unparallel movement that would cause upholstery binding is not forced by cross-bracing link assemblies 361.

As can be seen in FIGS. 9 and 10, link assemblies 361 can be formed by two link members 362 and 366 that are pivotally coupled together at 365. Link member 366 in turn is pivoted to cross-bracing member 348 at 350, while link member 362 is pivotally coupled to an upper side frame member 327 by a cylindrical end 363. A receiver member 381 is mounted to each side frame member 327 to support the seat carrying members 341 in the deployed position of FIG. 9.

In order to bias link assemblies 361 to both the folded and the deployed conditions, torsion springs 360 may be coupled between members 362 and 366. Slot 370 and limit pin 375 limit maximum folding and unfolding, and the biasing torsional springs 360 will be seen to provide an over-center, bi-stable link assembly 361. Recess 382 in link member 362 will be seen to receive seat support tube 341 in the deployed condition.

Turning now to FIGS. 11-15, a further embodiment of the foldable wheelchair assembly, wheelchair frame and method of the present invention can be described.

In the embodiment of FIGS. 11-15, a further reduction in the number of components, and accordingly weight, of the cross-bracing assembly has been accomplished. Moreover, the link assembly has been incorporated into and forms a part of the cross-bracing members themselves.

Figure 11:
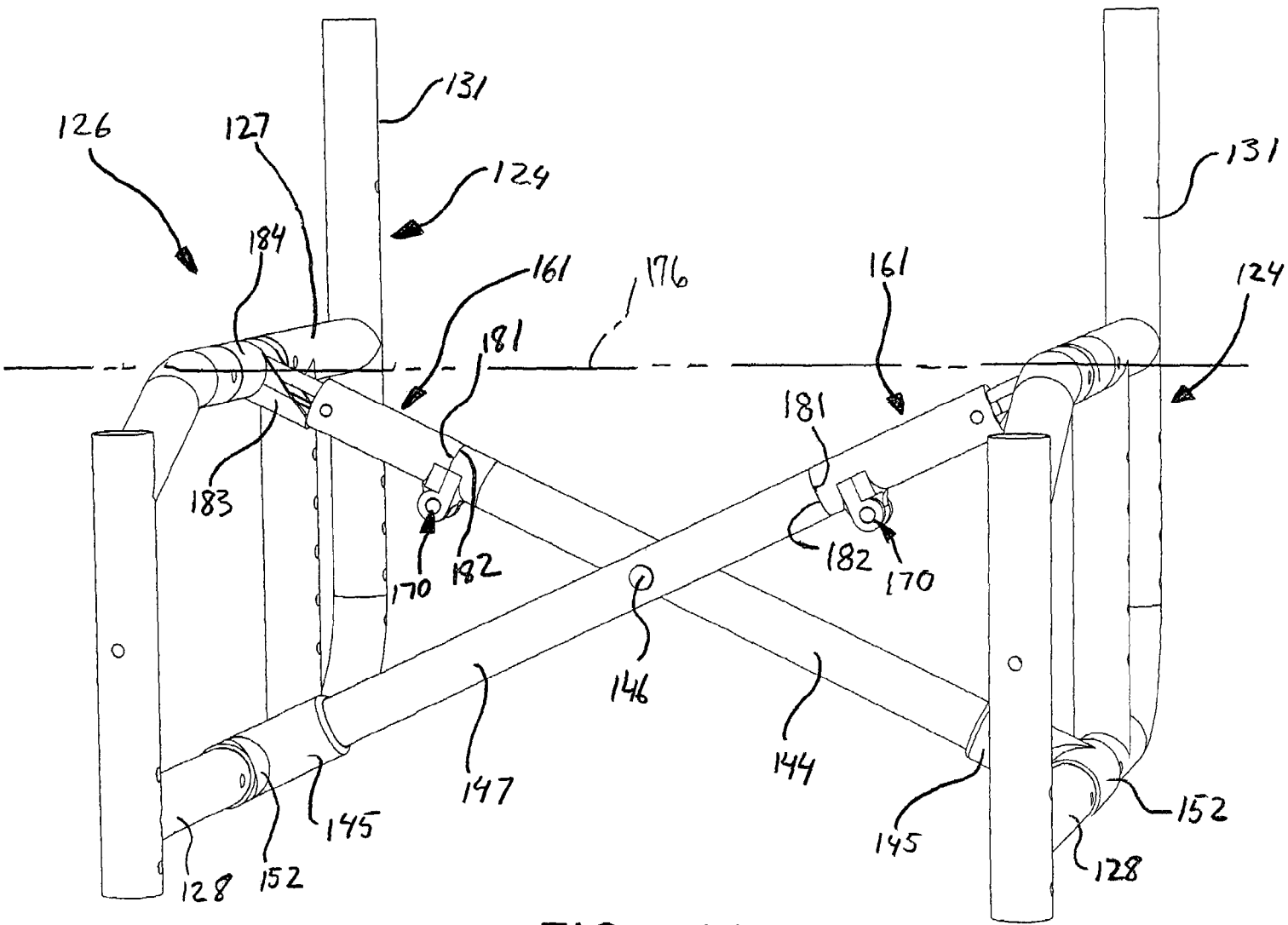
FIG. 11 is a top pictorial view, corresponding to FIG. 3, of still another alternative embodiment of a foldable wheelchair frame assembly of the present invention.
Figure 12:
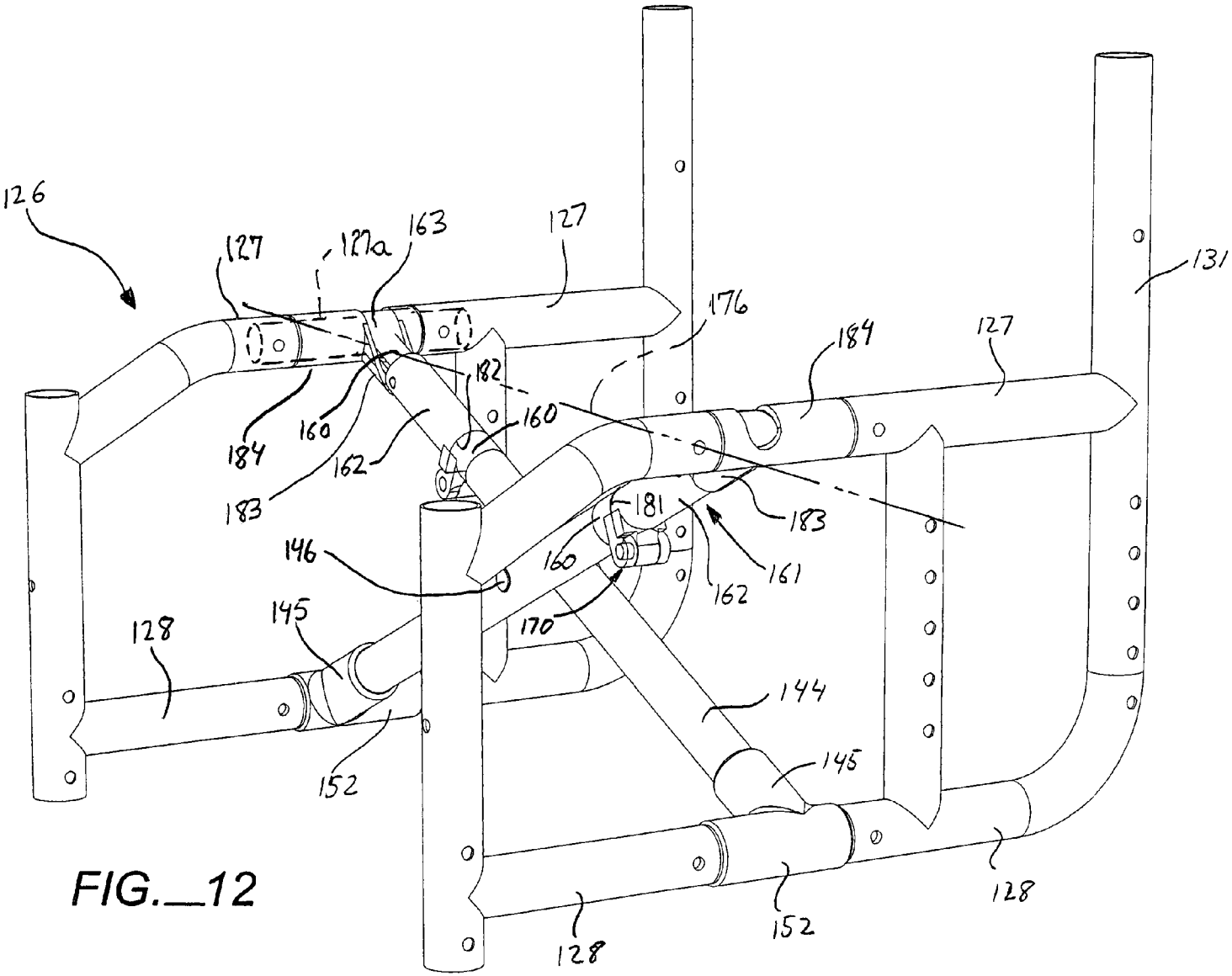
FIG. 12 is a side pictorial view of the frame assembly of FIG. 11 shown in a fully deployed position.

In FIGS. 11 and 12, a wheelchair frame assembly, generally designated 126, is shown in which there are side frames 124 which are coupled together by a cross-bracing frame assembly, generally designated 136. This wheelchair frame, as well as the embodiments of FIGS. 7-10, obviously can be used and substituted for the frame 26 shown with the wheelchair 21 of FIG. 1 and the assembled wheelchair would have all the components above described in connection with wheelchair 21.

As will be seen from FIG. 11, cross-bracing frame assembly 136 includes tubular cross-bracing members 144 and 147 which are pivotally coupled together proximate their mid-points by a pivot pin 146. The lower ends of tubular members 144 and 147 are received in sockets 145 which are secured to sleeves 152 pivotally mounted on a lower side frame member 128 in a manner analogous to that described for the embodiment of FIGS. 1-6.

In order to facilitate the movement between deployed and collapsed or folded positions without splaying of backrest supporting tubular frame members 131, a link assembly 161 is preferably provided as part of the cross-bracing assembly in the upper ends of cross-bracing tubes 144 and 147. The construction of the link assembly of this embodiment can best be seen in FIG. 15.

Link assembly 161 is an extensible link which includes a sleeve 162 having a bore 164 in which slider member 166 is slidably telescoped. Member 166 includes an annular or ring end 163 which can be rotatably mounted to a side frame member, in this case, a side frame member 127*a* extending between the upper side frame member tubular member 127. Slidable link 166 is preferably formed with a transversely extending slot 169, and a pin 171 extends transversely through sleeve 162 and through slot 169 so as to limit displacement of slider link 166. A compression spring 172 biases the link assembly toward an extended position.

Figure 6:
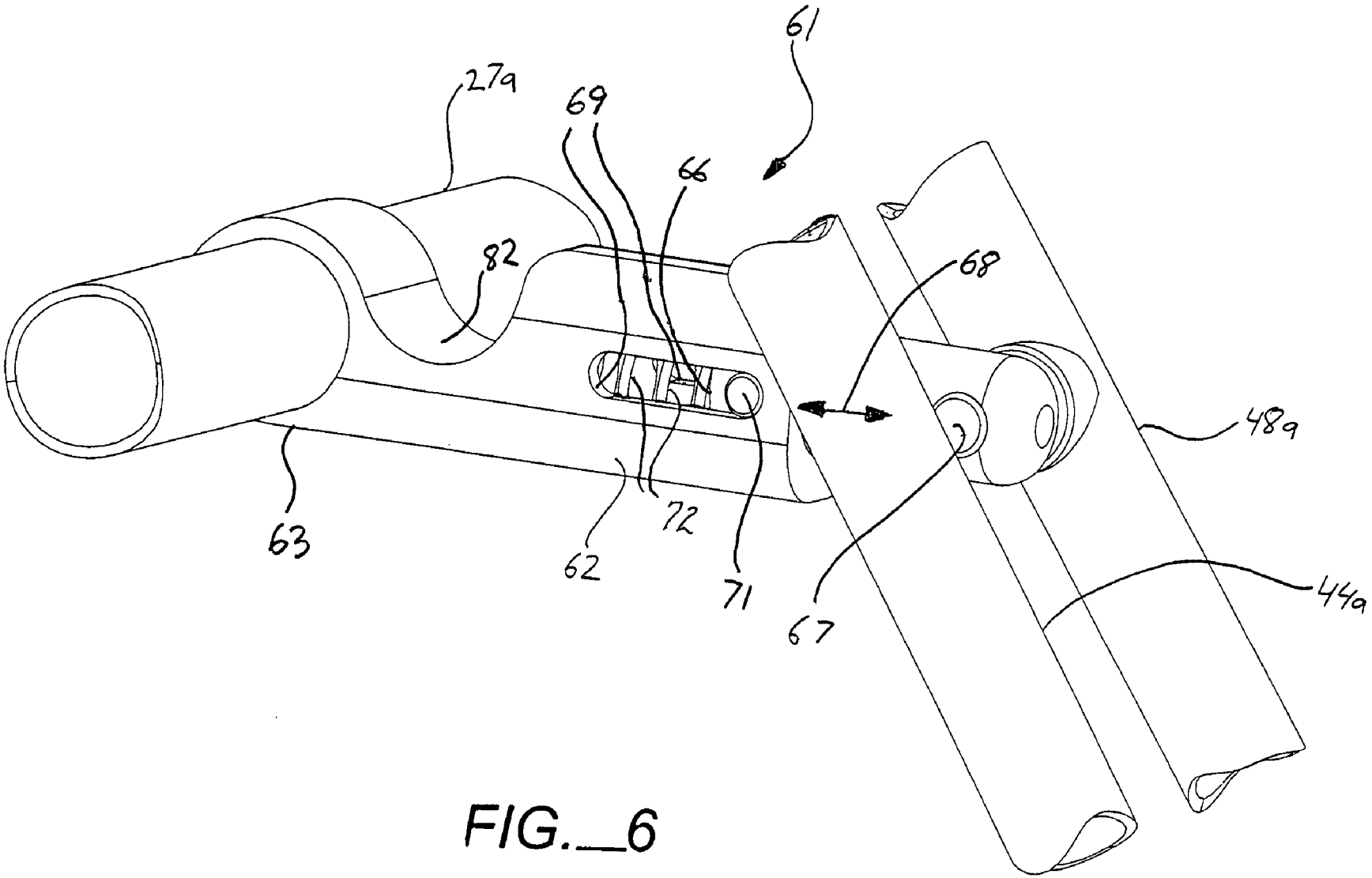
FIG. 6 is an enlarged pictorial view of the extensible link assembly employed in the wheelchair of FIG. 1.
Figure 15:
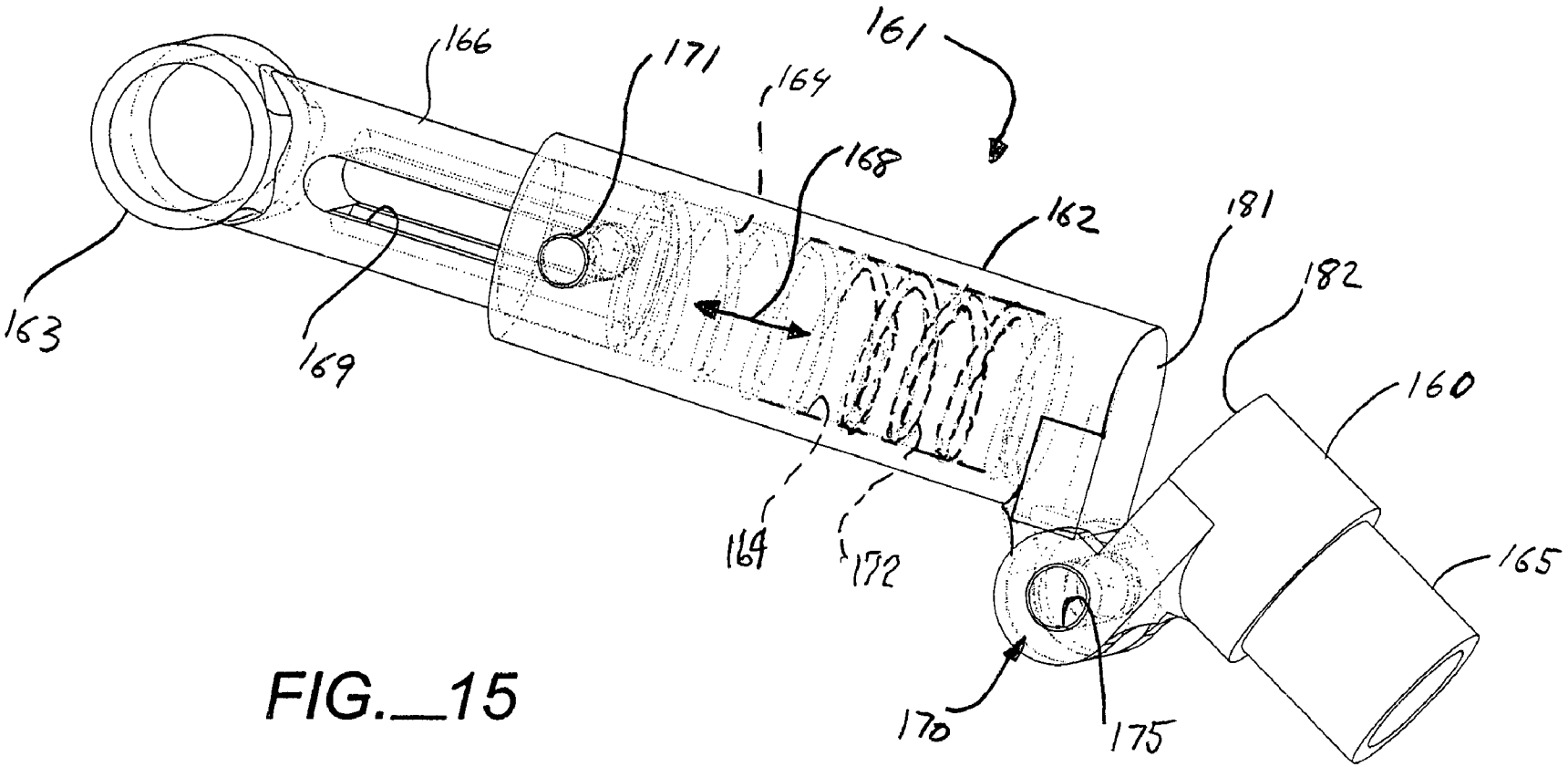
FIG. 15 is an enlarged, pictorial view of an extensible link assembly employed in the frame assembly of FIG. 11.

In the embodiment of the extensible link assembly 161 of FIG. 15, there are two reversals of parts as compared to link assembly 61 of FIG. 6. First, link member 166 is slotted, not sleeve 162. Second, since link member 166 is pivotally mounted by ring 163 to upper side frame member 127*a*, it is sleeve 162 which reciprocates, as indicated by arrows 168, instead of slider 166.

Extensible link assembly 161 is mounted to a remainder of the cross-bracing assembly by an end portion 160 which includes a stub 165 which telescopes inside of the cross-bracing members 144 and 147. End 160 is hinged by a hinge assembly 170 to a remainder of the extensible link assembly and particularly sleeve 162. A transverse pin extends through bores 175 of the hinge and hingedly couples end 160 to sleeve 162.

In the embodiment of FIGS. 11-15, therefore, extensible link 161 is provided as an axial extension of the cross-bracing members themselves, rather than being mounted in side-by-side relation, as was the case for the extensible link embodiment of FIGS. 1-6.

Operation of the extensible link assembly of FIGS. 11-15 now can be described and is similar to that of the link assembly of FIGS. 1-6. Link assembly 161 is bi-stable over-center link assembly, as was the case for the embodiment of FIGS. 1-6, and in FIG. 12 links 161 will be seen in a position below the plane of center line 176 when the frame is in the fully deployed position. Sleeve 162 will be extended relative to member 166 by reason of the biasing of the sleeve away from link 166 by compression spring 172.

Figure 13:
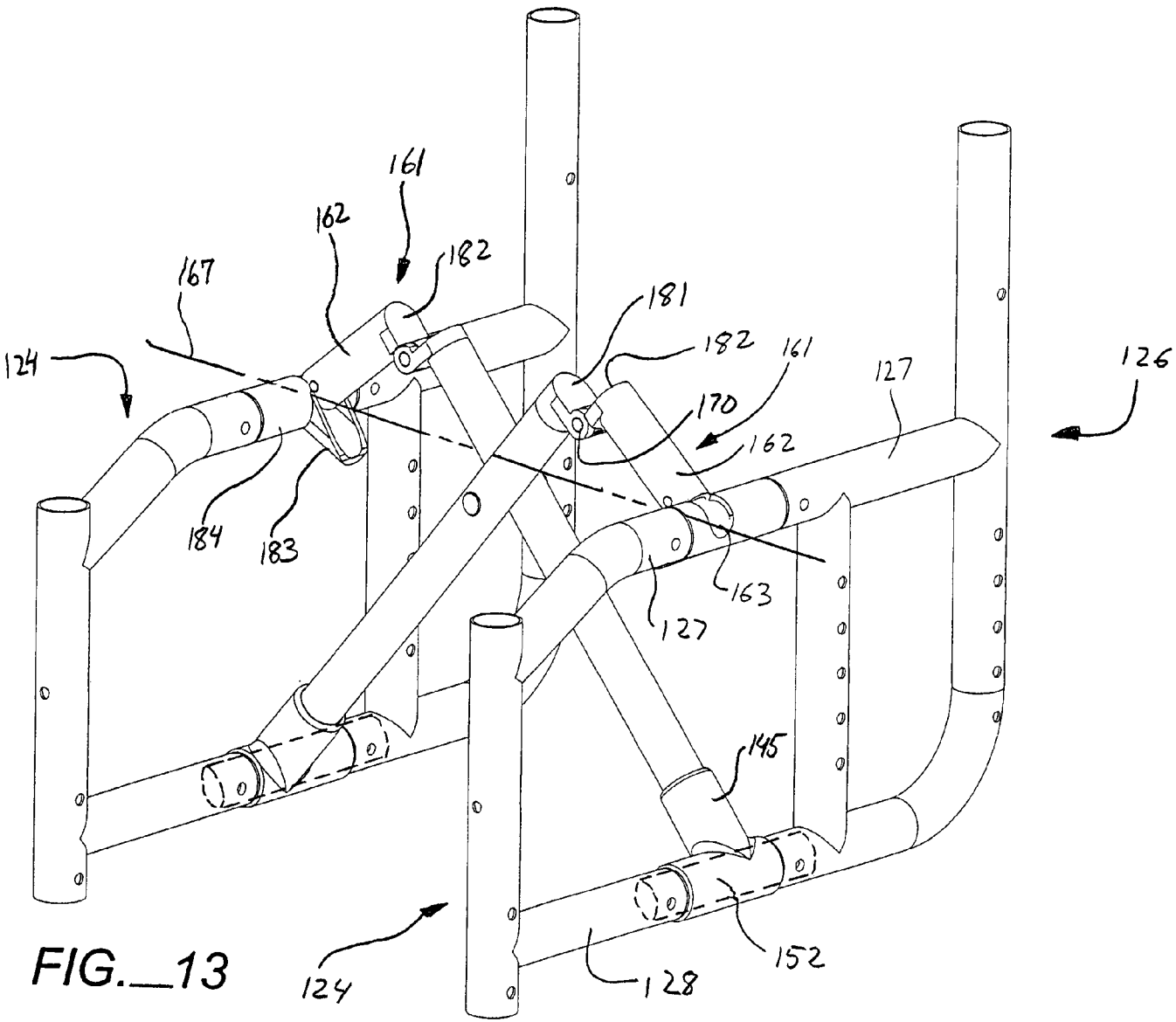
FIG. 13 is a side pictorial view of the frame assembly of FIG. 11, shown in a partially folded position.
Figure 14:
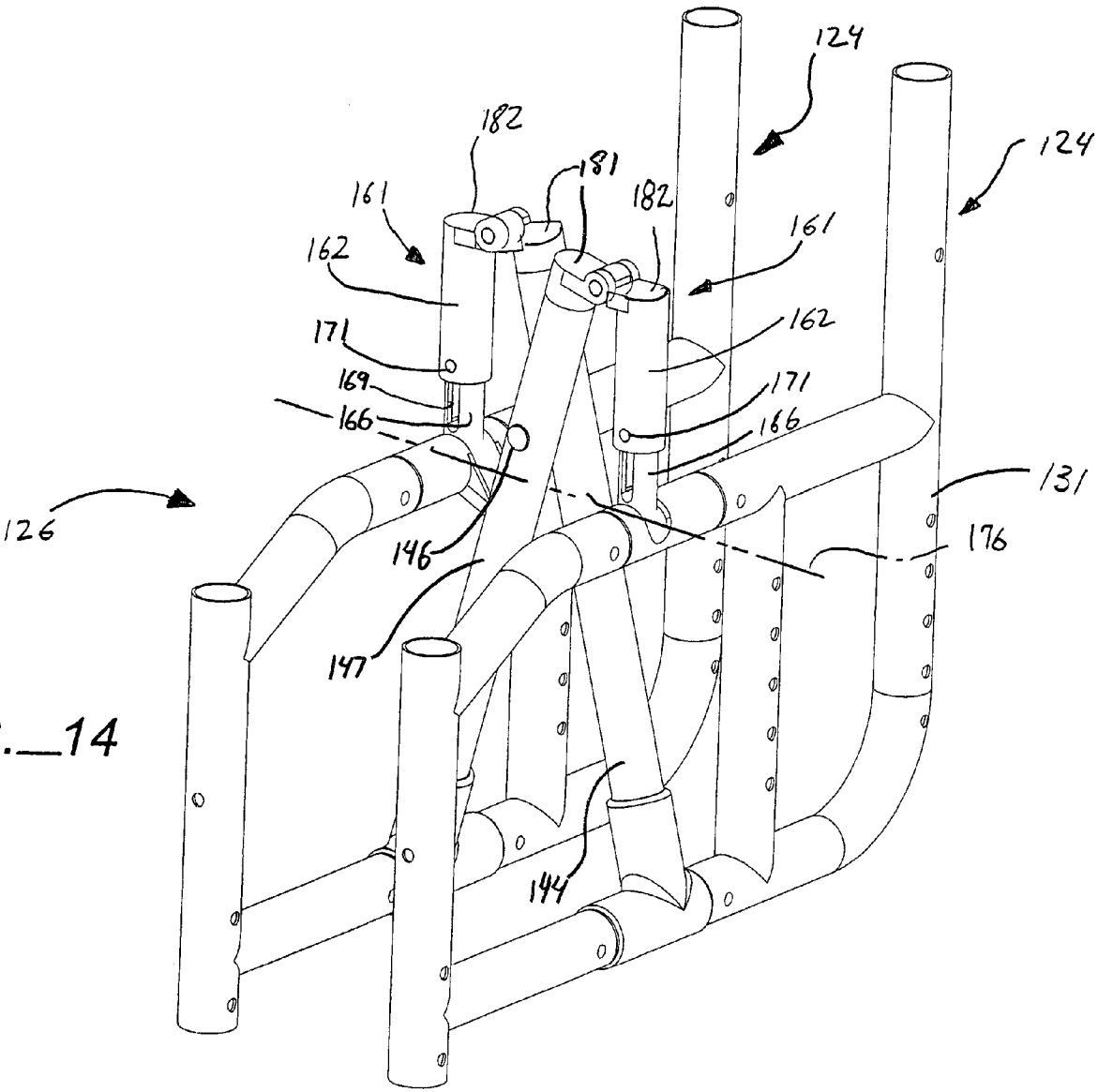
FIG. 14 is a side pictorial view of the frame assembly of FIG. 11, shown in a fully folded position.

In FIG. 13, frame 126 is partially collapsed or folded. Thus, the links 161 have hinged at pivot point 170, with the sleeve portion 162 rotating upwardly about upper frame members 127*a*. The sleeve, therefore, is now crossed above center line 176, and the compression spring is biasing the sleeve in an upward direction toward the fully folded position of FIG. 14. With hinge assembly 170 located on an underneath side of extensible link member 161, the link member, which is the upper portion of cross-bracing tubes 144 and 147, can brake or open up as the tubes scissor into a near vertical orientation. In the fully folded position of FIG. 14, sleeves 162 are in a near vertical orientation and the cross-bracing members 144 and 147 have scissored into a near vertical orientation so that side frames 124 are in close proximity to each other. Transverse pins 171 have moved in slots 169 to uppermost position in slots.

As will be understood, the end surfaces 181 and 182 of the hinged extensible link assembly will abut each other in the deployed position of FIGS. 11 and 12 to thereby further limit opening of the frame assembly and separation of the side frames 124. Additionally, a receiver 183 can be mounted to a sleeve 184 carried by upper frame member 127*a* which sleeve will limit the rotation of extensible link sleeve member 162 when moving to the unfolded or deployed position. Thus, the combination of the abutting surfaces 181 and 182 and receivers 183 support the frame assembly in the fully deployed position in a rigid and secure fashion.

As was the case for the embodiment of FIGS. 1-6, a single extensible link assembly 161 can be employed as a portion of the cross-bracing assembly on one side only of the wheelchair. Moreover, in the embodiment of FIGS. 11-15, it also would be possible to incorporate extensible link assemblies in the bottom ends of the cross-bracing members 144 and 147, with pivotal sockets 145 and sleeves 152 being provided to couple the cross-bracing X-tubes to top side frame members 127, instead of to bottom side frame members 128. This reversal of parts could have an advantage for some applications, for example, by causing less displacement of sling seat upholstery (not shown) which normally would be mounted between upper frame members 127 on the side frames. As will be seen from FIG. 14, in the folded condition, the sling seat must be flexible enough to extend up over the hinged upper ends of the extensible links.

As also will be appreciated, the hinged link assemblies 161 can be moved closer to the pivot point 146 for the cross-bracing members, with the slidable member 166 being longer or being mounted to another stub cross-bracing tube member (not shown) which would be pivotally coupled to the top tubular frame members 127*a*. As was the case for the other embodiments, the embodiment of FIGS. 11-15 does not force side frames 124 to move in an unparallel manner or to splay apart when folding or unfolding. The ability to slide the sleeve over link member 166, as the assembly crosses center line 176, prevents forcing of the side frames into arcuate motion. The overall length of the extensible sleeve is at a minimum on center line 176 and is longer in both the folded and the deployed positions so as to provide a bi-stable construction. Again, the extensible link assembly in the cross-bracing structure allows both the backrest upholstery and the sling seat to be relatively taut in the fully deployed position for better positioning of the user on the wheelchair and for improved frame rigidity.

In the embodiment of FIGS. 11-15, smooth folding and unfolding operation is achieved while the number of components and their weight have been reduced. Although not shown, the rear posts or tubular frame members 131 also can be hinged to fold in a forward direction, which folding is more easily accomplished if the extensible link assemblies are used at the bottom of the cross-bracing members so as not to interfere with folding down of the backrest structure.

Having described four embodiments of the apparatus of the present invention, the method of providing a foldable wheelchair can be set forth. The method is comprised of the steps of coupling a pair of side frames 24, 124, 224, 324, together by a cross-bracing frame assembly for lateral movement of the side frames between a deployed position and a folded position. The method further includes the step of mounting at least one link assembly 61, 161, 261, 361 in the cross-bracing frame assembly in a position between at least one of the side frames and a remainder of the cross-bracing assembly for lateral movement extension and retraction or pivotal movement of the link assembly to enable the side frames to move between the deployed and folded positions without being forced to undergo unparallel movement. The method is most preferably accomplished by pivotally connecting an extensible link assembly at opposite ends to the side frames and to the remainder of the cross-bracing frame for movement over a center line. The method also includes the step of resiliently biasing the link assembly toward an extended condition so as to the stabilize cross-bracing assembly in both the folded and the deployed positions and so as to smooth the motion of the folding assembly as the link assembly passes over the center line during folding. In a most preferred form of the method, the extensible link assembly is mounted, during the mounting step, between each side frame and the remainder of the cross-bracing frame assembly.

Alternatively, in the present method a pivotal multi-element link assembly is mounted between the side frames and the cross-bracing assembly, and pivotal movement between the link elements employed to allow change of the link assembly length during folding and unfolding.

The foregoing descriptions of the specific embodiments of the present invention have been presented for the purpose of illustration and description. They are not intended to be exhaustive or to limit the invention to the precise forms disclosed. Obviously, many modifications and variations are possible in light of the above teaching. The embodiments were chosen and described in order to best explain the principles of the invention and its practical application to allow one skilled in the art to best utilize the invention and its embodiments with various modifications, as are suited to the particular use contemplated. It is intended that the scope of the invention be defined by the claims appended hereto and their equivalents.

What is claimed is:

1. A foldable wheelchair frame assembly comprising:

a pair of side frames;

a cross-bracing frame assembly coupling the side frames together for movement transversely between a spaced apart deployed position and a proximate folded position; and a link assembly mounted in the cross-bracing frame assembly in a position between at least one of the side frames and a remainder of the cross-bracing frame assembly, the link assembly being formed and arranged for variation of the overall length of the link assembly in a direction extending transversely between the side frames during movement of the side frames between the deployed position and the folded position to prevent forcing of the side frames into unparallel movement during movement of the side frames between the deployed position and the folded position.

2. The apparatus as defined in claim 1 wherein, the link assembly is pivotally coupled at one end to a side frame and is pivotally coupled at the other end to the remainder of cross-bracing frame assembly, and the link assembly includes a slidable link member reciprocally mounted to a sleeve for extension and retraction of one of the link member and the sleeve during pivoting of the link assembly, and a spring biasing member biasing the link member and the sleeve toward an extended condition.

3. The apparatus as defined in claim 2 wherein, the link assembly moves along an arcuate path between opposite path end points over a center line during movement of the side frames between the deployed position and the folded position, and the slidable link member is retracted at the center line and is extended at the path end points.

4. The apparatus as defined in claim 1 wherein, the link assembly further includes a biasing member biasing the link assembly toward an extended condition.

5. The apparatus as defined in claim 1 wherein, the cross-bracing frame assembly is an X-tube assembly including two tubular cross-bracing members pivotally coupled to each other proximate a midpoint of the lengths thereof, and the cross-bracing members are pivotally coupled to the side frames proximate lower ends of the cross-bracing members.

6. The apparatus as defined in claim 5 wherein, the wheelchair frame assembly includes two extensible link assemblies mounted in the cross-bracing frame assembly with each link assembly being formed as over-center extensible and retractable link assembly, and each of the link assemblies being pivotally coupled at one end to an upper end of a cross-bracing member and being pivotally coupled at an opposite end to a side frame.

7. The apparatus as defined in claim 6 wherein, each over-center link assembly has an extensible and retractable slidable link member resiliently biased toward the extended condition.

8. The apparatus as defined in claim 6 wherein, each extensible link assembly is provided as an extension of a cross-bracing member in the cross-bracing frame assembly, the cross-bracing member having an upper portion thereof hinged to a lower portion of the cross-bracing member, a slidable link member carried by the upper portion of the cross-bracing member with one end of a slidable link member being pivotally coupled to a side frame and an opposite end of the slidable link member being slidably mounted to the upper portion of the cross-bracing member.

9. The apparatus as defined in claim 8 wherein, the slidable link member is resiliently biased toward an extended position.

10. The apparatus as defined in claim 9 wherein, the slidable member is mounted in telescoped relation to the upper portion of the cross-bracing member.

11. The apparatus as defined in claim 10 wherein, the slidable link member is formed with an elongated slot extending transversely through the slidable link member, and the upper portion of the cross-bracing member includes a transversely extending pin positioned to and extending through the slot in the slidable link member.

12. The apparatus as defined in claim 8, and a receiver structure carried by the side frame, and the receiver structure being formed to receive and support one of the slidable link member and the upper portion of the cross-bracing member when the side frames are in the deployed position.

13. The apparatus as defined in claim 1 wherein, the link assembly is provided by a sleeve pivotally coupled to a side frame at one end thereof and having a link member slidably mounted to the sleeve at an opposite end thereof, the slidable link member being pivotally coupled to the remainder of the cross-bracing frame assembly.

14. The apparatus as defined by claim 13 wherein, the cross-bracing frame assembly is provided by an X-tube assembly including two pairs of cross-bracing tubular members with each pair of cross-bracing tubular members being pivotally coupled to each other proximate a midpoint of the length of the cross-bracing members, and the two pairs of cross-bracing members being spaced apart from each other in a fore and aft direction of the wheelchair frame assembly.

15. The apparatus as defined in claim 14 wherein, the link assembly is mounted between the two pairs of cross-bracing members and coupled to upper ends of both pairs of cross-bracing members.

16. The apparatus as defined in claim 15 wherein, each of the upper ends of the pairs of cross-bracing members carry a seat rail member extending in a fore and aft direction substantially parallel to the side frames.

17. The apparatus as defined in claim 16 wherein, each side frame includes an upper side frame member, and the seat frame members are positioned in side-by-side relation to the upper side frame members.

18. The apparatus as defined in claim 1 wherein, the link assembly includes at least two link members pivotally coupled to each other for variation of the overall length of the link assembly, and a spring biasing member mounted to the link members to resiliently bias the link members toward an extended condition.

19. The apparatus as defined in claim 18 wherein, the spring biasing member is a torsion spring.

20. The apparatus as defined in claim 1 wherein, the link assembly is pivotally coupled at one end to an arm mounted to a side frame, the arm extending downwardly below an upper member of the side frame.

21. The apparatus as defined in claim 20 wherein, the link assembly includes a slidably link member reciprocally mounted to a sleeve for extension and retraction to vary the overall length of the link assembly, and a spring biasing member mounted to bias the link member and the sleeve toward an extended condition.

22. A foldable wheelchair frame assembly comprising: a pair of tubular, substantially vertically oriented, side frame assemblies; an X-tube assembly including at least two tubular cross-bracing members pivotally coupled to each other proximate midpoints thereof and pivotally coupled at a first end of the cross-bracing members to the side frame assemblies for movement of the side frame assemblies between a spaced apart deployed position and a proximate folded position; and an extensible link assembly mounted in the cross-bracing assembly in a position between each side frame assembly and a second end of the cross-bracing members, the link assembly including a link member formed and mounted for variation of the overall length of the link assembly during movement of the side frames between the deployed position and the folded position, and a spring biasing member biasing the link assembly toward an extended condition to allow the side frames to move between the folded position and the deployed position without being forced to undergo unparallel movement.

23. The apparatus as defined in claim 22 wherein, the link assembly includes a tubular sleeve slidably receiving the link member therein; the link member is pivotally coupled to an upper member of the side frame assembly; and the sleeve member is pivotally coupled to the cross-bracing member.

24. The apparatus as defined in claim 23 wherein, the link assembly moves along an arcuate path between two path end points over a center line during movement of the side frame assemblies between the deployed position and the folded position, and the slidable link member is retracted by a maximum amount at the center line and is extended from the retracted position at both path end points.

25. The apparatus as defined in claim 24 wherein, the spring biasing member biases the slidable link member toward the extended condition.

26. The apparatus as defined in claim 22 wherein, the link assembly includes two link members pivotally coupled together for arcuate movement to change the overall length of the link assembly, and the spring biasing member is a torsion spring mounted to cause pivoting of the two link members toward the extended condition.

27. A link assembly for use in a foldable wheelchair frame assembly including a pair of side frames, and a cross-bracing frame assembly coupling said side frames together for movement between a spaced apart deployed position and a proximate folded position, the link assembly comprising: a first link member formed proximate one end for pivotal mounting to one of the cross-bracing assembly and a side frame; a second link member formed proximate one end for pivotal mounting to the other of the cross-bracing assembly and the side frame; the first link member and the second link member being coupled to each other for relative movement to vary the overall length of the link assembly during movement of the side frames between the deployed position and the folded position; and a spring biasing member mounted to the link assembly to bias one of the first link members and the second link member toward an extended condition.

28. The apparatus as defined in claim 27 wherein, the first link member is a sleeve member, and the second link member is a slidable link member mounted inside the sleeve member.

29. The apparatus as defined in claim 27 wherein, the first link member and the second link member are pivotally coupled to each other, and the spring biasing member is a torsion spring.

30. A foldable wheelchair comprising:

a pair of substantially vertically oriented side frame assemblies including a backrest assembly and a foot rest assembly carried thereby;

a pair of drive wheels rotatably mounted to the side frame assemblies;

a pair of castor wheels rotatably mounted to the side frame assemblies in front of the drive wheels;

a cross-bracing assembly coupling the side frame assemblies together for lateral movement between a deployed position and a folded position; and a variable length link assembly mounted to form a part of the cross-bracing assembly and coupled to at least one of the side frames, the link assembly being formed and arranged for variation of the overall length of the link assembly in a direction extending transversely between the side frames during movement of the side frames between the deployed position and the folded position;

the link assembly being resiliently biased toward an extended condition; and the variation of the overall length of the link assembly being arranged to prevent forcing the side frames into unparallel movement during movement of the side frames between the deployed position and the folded position.

31. A foldable wheelchair frame assembly comprising:

a pair of side frames;

a cross-bracing frame assembly coupling the side frames together so as to be arranged for relative movement in a transverse direction extending between the side frames between a spaced apart deployed position and a proximate folded position; and a link assembly mounted in the cross-bracing frame assembly in a position between at least one of the side frames and a remainder of the cross-bracing frame assembly;

the link assembly being arranged for variation of the overall length of the link assembly in said transverse direction during movement of the side frames between the deployed position and the folded position; and the variation of the overall length of the link assembly being driven by movement of the side frames between the deployed position and the folded position such that forcing of the side frames into unparallel movement is prevented during movement of the side frames between the deployed position and the folded position.

* * * * *